US009460651B2

(12) United States Patent
Chun et al.

(10) Patent No.: US 9,460,651 B2
(45) Date of Patent: Oct. 4, 2016

(54) IMAGE PROCESSING APPARATUS AND METHOD FOR INCREASING IMAGE QUALITY AND REDUCING POWER CONSUMPTION

(71) Applicant: Samsung Display Co., Ltd., Gyeonggi-Do (KR)

(72) Inventors: Byung-Ki Chun, Gyeonggi-Do (KR); Yong-Seok Choi, Gyeonggi-Do (KR); Joo-Hyung Lee, Gyeonggi-Do (KR); Jong-Woong Park, Gyeonggi-Do (KR); Jeong-Eun Kim, Gyeonggi-Do (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 800 days.

(21) Appl. No.: 13/679,859

(22) Filed: Nov. 16, 2012

(65) Prior Publication Data

US 2013/0342585 A1 Dec. 26, 2013

(30) Foreign Application Priority Data

Jun. 20, 2012 (KR) ..... 10-2012-0066246

(51) Int. Cl.
*G09G 5/10* (2006.01)
*G09G 3/32* (2016.01)

(52) U.S. Cl.
CPC .... *G09G 3/3208* (2013.01); *G09G 2320/0271* (2013.01); *G09G 2330/021* (2013.01); *G09G 2360/16* (2013.01)

(58) Field of Classification Search
CPC ..... G09G 1/06; G09G 1/14; G09G 3/28; G09G 3/30; G09G 3/36; G09G 5/00; G09G 3/038; G09G 5/02
USPC ..... 345/89
See application file for complete search history.

(56) References Cited

U.S. PATENT DOCUMENTS

2008/0037867 A1* 2/2008 Lee ..... H04N 9/68 382/168

FOREIGN PATENT DOCUMENTS

| | | | |
|---|---|---|---|
| KR | 10-2008-0002141 | A | 1/2008 |
| KR | 10-0827237 | B1 | 4/2008 |
| KR | 10-2008-0064356 | A | 7/2008 |
| KR | 10-0910560 | B1 | 7/2009 |

* cited by examiner

*Primary Examiner* — Pegeman Karimi
(74) *Attorney, Agent, or Firm* — Knobbe Martens Olson & Bear LLP

(57) ABSTRACT

An image processing apparatus and image processing method are disclosed. The image processing apparatus includes an image input unit receiving input image data to obtain grayscale values of a display image, a modeling unit calculating a luminance change ratio for each grayscale value according to a change of an on-pixel ratio and a final luminance reflected by the luminance change ratio, a grayscale re-mapping unit determining a compensation grayscale value for compensating a luminance change ratio according to the on-pixel ratio of the input image data to display a target luminance corresponding to a predetermined grayscale value included in grayscale information of the input image data in the on-pixel ratio condition of the input image data, and an image output unit outputting an output image data compensating the input image data by the compensation grayscale value.

9 Claims, 7 Drawing Sheets

IMAGE PROCESSING APPARATUS AND METHOD FOR INCREASING IMAGE QUALITY AND REDUCING POWER CONSUMPTION

CROSS-REFERENCE TO RELATED APPLICATIONS

This application claims priority to and the benefit of Korean Patent Application No. 10-2012-0066246 filed in the Korean Intellectual Property Office on Jun. 20, 2012, the entire contents of which are incorporated herein by reference.

BACKGROUND

1. Field

The disclosed technology relates to an image processing apparatus and a method thereof, and particularly relates to an image processing apparatus and a method thereof for reducing power consumption by controlling luminance to not be increased and decreased more than necessary due to a load in an organic light emitting diode (OLED) display.

2. Description of the Related Technology

Recently, various digital devices for satisfying consumers' various demands have spread from a digital device having a large display such as a computer and a digital TV to a digital device having a small display such as a mobile phone, a PDA (personal digital assistant), and a PMP (portable multimedia player).

Particularly, in recent image display devices, according to a trend of larger display panel, a luminance imbalance of the panel is generated by a load effect. Because of the load effect, current is equally supplied to the entire panel such that luminance of a particular part is increased more than necessary, or the luminance of a particular part is excessively decreased. Accordingly, the load effect may be a factor in generating an incorrect luminance display and excessive power consumption.

In the image display device, to display the correct grayscale, development of the image processing apparatus and a method thereof for improving display quality and reducing power consumption is required.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

One inventive aspect is an image processing apparatus, including an image input unit configured to receive input image data from an external image source to obtain grayscale values for a display image, a modeling unit configured to calculate a luminance change ratio of a display image for each grayscale value according to a change of an on-pixel ratio of a display panel and a final luminance reflected by the luminance change ratio, and a grayscale re-mapping unit configured to determine a compensation grayscale value for compensating a luminance change ratio according to the on-pixel ratio of the input image data to display a target luminance corresponding to a predetermined grayscale value included in grayscale values. The image processing apparatus includes an image output unit configured to output output image data compensating the input image data by the compensation grayscale value.

Another inventive aspect is an image processing method, including obtaining grayscale values of a display image by receiving input image data from an external image source calculating an on-pixel ratio of the input image data based on the grayscale values, calculating a luminance change ratio of the display image for each grayscale value according to a change of the on-pixel ratio of the display panel and a final luminance reflected by the luminance change ratio, and determining a compensation grayscale value compensating a luminance change ratio according to the on-pixel ratio of the input image data to display a target luminance corresponding to a grayscale value in the on-pixel ratio condition of the input image data. The method also includes outputting output image data compensating the input image data by the compensation grayscale value.

DETAILED DESCRIPTION OF CERTAIN INVENTIVE EMBODIMENTS

Figure 1:
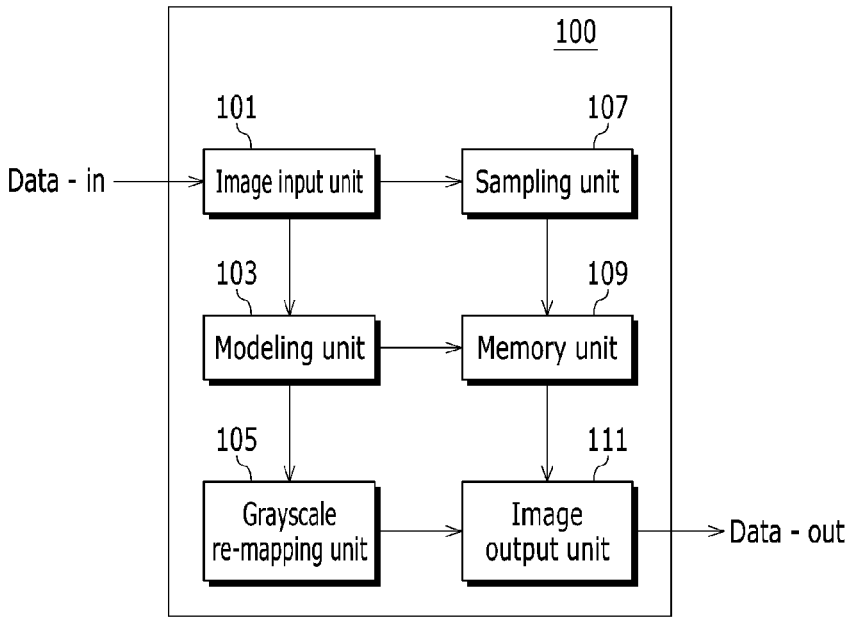
FIG. 1 is a block diagram of an image processing apparatus according to an exemplary embodiment.

Certain aspects are described more fully hereinafter with reference to the accompanying drawings, in which exemplary embodiments are shown. As those skilled in the art would realize, the described embodiments may be modified in various different ways, all without departing from the spirit or scope of the present invention.

The drawings and description are to be regarded as illustrative in nature and not restrictive. Like reference numerals generally designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of an image processing apparatus 100 according to an exemplary embodiment of the present invention.

As shown in FIG. 1, the image processing apparatus 100 includes an image input unit 101, a modeling unit 103, a grayscale re-mapping unit 105, a sampling unit 107, a memory unit 109, and an image output unit 111. The image processing apparatus is not limited to the constitution of the image processing apparatus of FIG. 1, and may include means for realizing the image processing methods discussed herein.

The image input unit 101 receives input image data (Data-in) from a predetermined image source to extract or obtain display information of the image data to be displayed to the display panel of the display device for each frame. Here, the display information includes a brightness value of the pixel obtained from an RGB type signal or a YCbCr type signal forming the input image, that is, the grayscale information.

The image input unit 101 divides the input image data Data-in by a pixel unit to obtain a brightness value of the pixel. The brightness value of the pixel is displayed by using 8 bit grayscale data, and may be one of 256 grayscales.

The modeling unit 103 calculates final luminance of the pixel based on the brightness value of the pixel. At this time, the calculated final luminance of the pixel is a luminance that is controlled by an estimating value of the luminance in which an actual light emitting luminance is calculated by a predetermined arithmetic equation.

The final luminance calculated from the modeling unit 103 uses a predetermined value reflected by a material characteristic of the display panel. The predetermined value determines the estimating value of the luminance. The predetermined value is a value calculated by dividing a luminance increasing ratio in the predetermined grayscale by a luminance (an ideal luminance−an OPR luminance) in the corresponding grayscale. The predetermined value is changed according to the material characteristic of the display panel.

Here, the ideal luminance is a ratio that is calculated by dividing the luminance when the pixel ideally emits light according to a predetermined grayscale by the luminance of a 255 grayscale of a full white. Hereafter, the ideal luminance may be referred to as a gamma luminance.

For example, when the luminance of 300 nit is ideally display in the full white 255 grayscale data, 300 nit is 100% gamma luminance. Also, the gamma luminance of the corresponding grayscale is expressed by a percentage of which the luminance displayed according to the grayscale data lower than a 255 grayscale is divided by 300 nit. For example, when the luminance according to a 127 grayscale is 150 nit, the gamma luminance of the 127 grayscale becomes 50%.

The OPR luminance defines a change of the gamma luminance value that is ideally displayed in the predetermined grayscale for an on-pixel ratio as a percentage.

Here, the on-pixel ratio (OPR) is a ratio of the pixel number of the first region where the predetermined grayscale is displayed in a portion of the display panel for the pixel number of the entire display panel.

The remaining region except for the first region of the display panel may be displayed with a predetermined grayscale such as a black grayscale. The on-pixel ratio may be increased or decreased while changing the size of the first region, and the change of the ideal luminance displayed in the corresponding grayscale according to the on-pixel ratio may be defined by the OPR luminance.

If the on-pixel ratio is respectively 25% and 50%, in the example, the OPR luminance of the 255 grayscale is respectively 25% and 50%, and the OPR luminance of the 127 grayscale is respectively calculated at 12.5% and 25% for 50% gamma luminance.

The gamma luminance and the OPR luminance are converted into a percentage, however, in some embodiments they may be applied with a luminance unit without conversion.

In the modeling unit 103, the calculation of the final luminance value according to the change ratio of the OPR uses the characteristic that the change ratio of the actual luminance at which predetermined grayscale data is displayed as a test result for displaying the image in the actual display panel is proportional to a difference between the ideal luminance and the OPR luminance.

The modeling unit 103 calculates the final luminance value to be displayed in the display panel without measuring the actual luminance for the grayscale data one by one. The actual luminance change ratio is displayed by the following Equation 1.

$$\text{The actual luminance change ratio } (R_L\text{var}) = (RL-IL)/IL \qquad \text{Equation 1}$$

Here, RL the actual luminance, and IL is the luminance when the predetermined grayscale data is ideally displayed.

Assuming that the full white is increased according to the load effect, a method of decreasing the gamma voltage of all image data for the full white to be correctly displayed with the ideal luminance may be used. However, the actual load effect increases the luminance of the image displayed in the display panel, but it may decrease the luminance. Accordingly, when decreasing the gamma voltage of all image data to be suitable for the ideal luminance of the full white, the decreased luminance in a portion of the grayscale region may be further decreased such that the display quality may be deteriorated.

Accordingly, the modeling unit 103 of the image processing apparatus according to an exemplary embodiment correctly calculates the increasing/decreasing ratio of the luminance displayed in the decreased grayscale region as well as the grayscale region where the actual luminance is increased, and obtains the final luminance according to the entire grayscale of the display panel through the modeling process. Referring to the block diagram shown in FIG. 1, the modeling unit 103 is connected to the memory unit 109, and may store the final luminance value according to the OPR change ratio of the entire grayscale obtained through the modeling process to the memory unit 109 as a lookup table.

Figure 2:
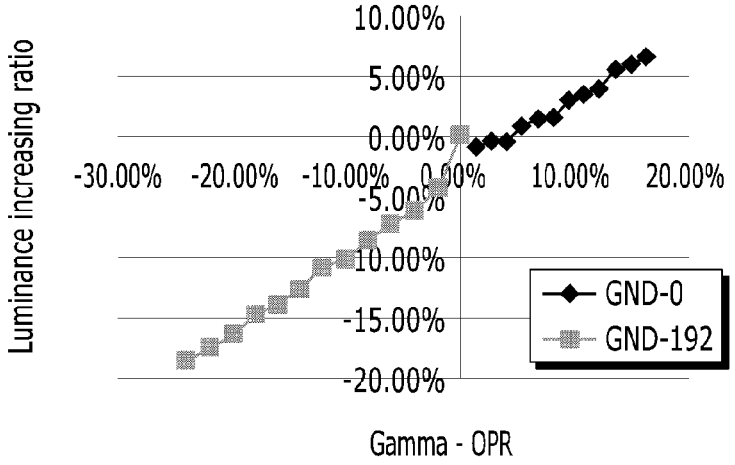
FIG. 2 is a graph showing a relation of a luminance increasing ratio according to an OPR change in 127 grayscales.
Figure 3:
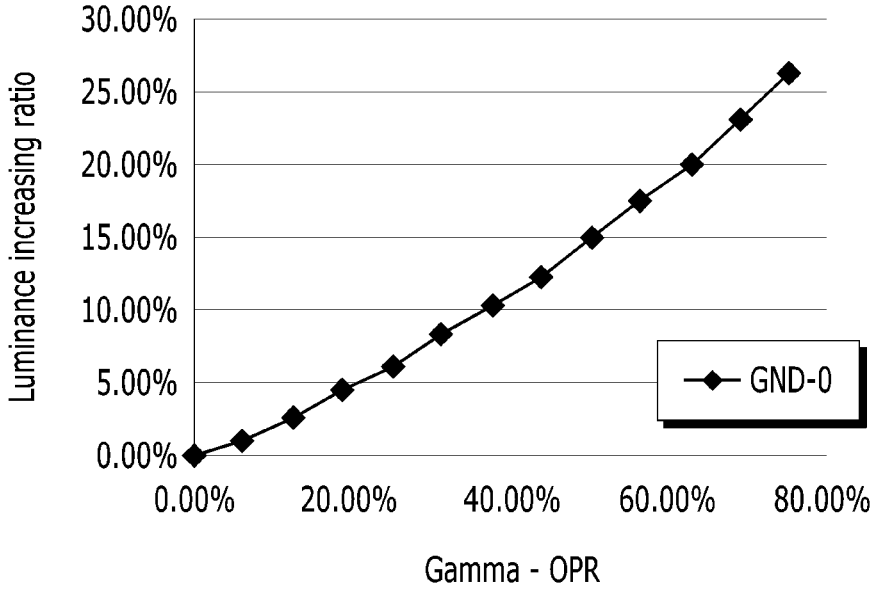
FIG. 3 is a graph showing a relation of a luminance increasing ratio according to an OPR change in 255 grayscales.

FIG. 2 and FIG. 3 show the relation of the luminance increasing ratio according to the on-pixel ratio (OPR) change in a 127 grayscale and a 255 full white grayscale as graphs by measuring actual luminance.

FIG. 2 shows the luminance increasing ratio that is changed according to the change of the on-pixel ratio with respect to the remaining panel region (a ground color, GND) of a 0 grayscale or a 192 grayscale in a case that the image data is 127 grayscale in the first region of the display panel.

Referring to FIG. 2, regardless of the ground color (GND) of a 0 grayscale or a 192 grayscale, the luminance of a 127 grayscale is increased in proportion to the difference (Gamma-OPR) between the ideal luminance (the gamma luminance) and the OPR luminance.

Meanwhile, when the ground color (GND) is a 0 grayscale and the image data in the first region of the display panel is displayed with a 255 full white grayscale, like FIG. 3 displaying the luminance increasing ratio according to the change of the on-pixel ratio, the luminance increasing ratio is increased in proportion to the difference (Gamma-OPR) between the ideal luminance (the gamma luminance) and the OPR luminance. As measuring result, in a 255 grayscale, the luminance increasing ratio/Gamma-OPR (the predetermined value as described above) is about 0.3513. A display constant is a value obtained by actually measuring the luminance of the image data displayed in the full white 255 grayscale and is a unique value that is changed according to the constitution material characteristic of the pixel of the display panel. For example, the display constant is obtained through the value that is actually measured in a 255 grayscale, however in the same display panel, the same predetermined value may also be obtained in a different grayscale.

In the image processing apparatus 100 of FIG. 1, the sampling unit 107 is connected to the image input unit 101, and may sample and measure the actual luminance according to the change of the on-pixel ratio for the predetermined grayscale in the actual image data.

According to another exemplary embodiment, the predetermined value calculated in the modeling unit 103 may be calculated in the sampling unit 107. That is, in the display panel, the predetermined value (the luminance increasing ratio/Gamma-OPR) for the predetermined grayscale may be calculated by measuring the actual luminance increasing ratio for the OPR. At this time, the on-pixel ratio (OPR) may be obtained by summing the input image data and dividing it by the pixel number of the entire display panel.

According to an exemplary embodiment, the image processing apparatus 100 may not always include the sampling unit 107, and the predetermined value according to the display panel characteristic may be given as an offset value for the display panel.

The change ratio of the actual luminance is not measured and represented as a graph in the low grayscale region, however in the low grayscale region, like FIG. 2 or FIG. 3, the luminance change ratio according to the OPR change ratio for the corresponding grayscale is not always increased, and may be decreased, and the luminance decreasing ratio is also proportional to the difference (Gamma-OPR) between the ideal luminance (the gamma luminance) and the OPR luminance in the corresponding grayscale.

As the difference (Gamma-OPR) between the ideal luminance (the gamma luminance) and the OPR luminance is increased according to the decreasing of the on-pixel ratio (OPR), the luminance increasing ratio in the high grayscale region or the luminance decreasing ratio in the low grayscale region is proportionally large. Accordingly, the final luminance is proportionally increased or decreased according to the on-pixel ratio compared with the luminance corresponding to the corresponding grayscale.

Accordingly, the modeling unit 103 of the image processing apparatus of the present invention may utilize the difference (Gamma-OPR) between the ideal luminance (the gamma luminance) and the OPR luminance when arithmetically obtaining the final luminance corresponding to the actual luminance. That is, the final luminance calculated in the modeling unit 103 is reflected by the luminance change ratio of the corresponding grayscale due to the load effect in the current image, and has little difference with the actual measured luminance.

Arithmetic equations used in the modeling unit 103 are Equation 2 and Equation 3 as follows, and the final luminance for the corresponding grayscale is obtained according to the change of the on-pixel ratio.

In the following equations, the luminance of the full white 255 grayscale is determined as 100% and the final luminance is calculated according to the change of the on-pixel ratio.

$$Del_Lx = DelG_Lx * 0.35 \quad \text{Equation 2}$$

$$M_LX = (G/255\hat{}2.2 + DelG_Lx * 0.35) * 100 \quad \text{Equation 3}$$

Here, Del_Lx is the luminance increasing ratio, DelG_Lx is the difference (Gamma-OPR) between the ideal luminance (the gamma luminance) and the OPR luminance, and 0.35 is the predetermined value of the corresponding display panel. It is described that the predetermined value is changed according to the material characteristic of the display panel pixel.

Also, M_LX is the final luminance that is arithmetically obtained through a modeling method, and G as the grayscale information included in the input image data is applied with the grayscale value of the entire grayscale region in the modeling process.

By using the above equations, a final luminance (MODEL) calculated by reflecting a luminance increasing ratio (MODEL (%)) according the change of the on-pixel ratio for a 255 grayscale in the modeling unit 103 is represented in Table 1.

For comparison, in Table 1 below, the luminance increasing amount (REAL (%)) that is actually measured and the actual final luminance (REAL) are represented together.

TABLE 1

| | | Luminance increasing amount | | Final luminance | |
|---|---|---|---|---|---|
| OPR | D-DELTA | REAL (%) | MODEL (%) | REAL | MODEL |
| 25.00% | 75.00% | 26.35% | 26.25% | 384.60 | 384.31 |
| 31.25% | 68.75% | 23.23% | 24.06% | 375.10 | 377.65 |
| 37.50% | 62.50% | 20.04% | 21.88% | 365.40 | 370.99 |
| 43.75% | 56.25% | 17.61% | 19.69% | 358.00 | 364.33 |
| 50.00% | 50.00% | 14.88% | 17.50% | 349.70 | 357.67 |
| 56.25% | 43.75% | 12.35% | 15.31% | 342.00 | 351.01 |
| 62.50% | 37.50% | 10.38% | 13.13% | 336.00 | 344.35 |
| 68.75% | 31.25% | 8.34% | 10.94% | 329.80 | 337.69 |
| 75.00% | 25.00% | 6.18% | 8.75% | 323.20 | 331.04 |
| 81.25% | 18.75% | 4.50% | 6.56% | 318.10 | 324.38 |
| 87.50% | 12.50% | 2.60% | 4.38% | 312.30 | 317.72 |
| 93.75% | 6.25% | 1.12% | 2.19% | 307.80 | 311.06 |
| 100.00% | 0.00% | 0.00% | 0.00% | 304.40 | 304.40 |

As shown in Table 1, as the on-pixel ratio (OPR) is decreased, the difference (Gamma-OPR) of the ideal luminance (the gamma luminance) and the OPR luminance is increased such that the luminance increasing amount is increased, and the final luminance has a larger width than 300 nit that is the ideal luminance value of a 255 grayscale.

Also, the differences between the luminance increasing amount that is actually measured, the actual measuring value (REAL) of the final luminance, and the final luminance value (MODEL) according to the luminance increasing ratio calculated in the modeling unit 103 are small. In detail, the difference between the luminance by the modeling and the actual measured luminance is within about 3%, and this proves that the luminance calculation through the modeling unit 103 is correct.

Accordingly, compared with a conventional method of receiving the input image data and actually measuring the luminance value according thereto for compensation, the image processing method of the present invention that compensates based on the final luminance value calculated by the modeling method provides a desired effect in an aspect of the compensation correction as well as convenience and simplicity.

Figure 4:
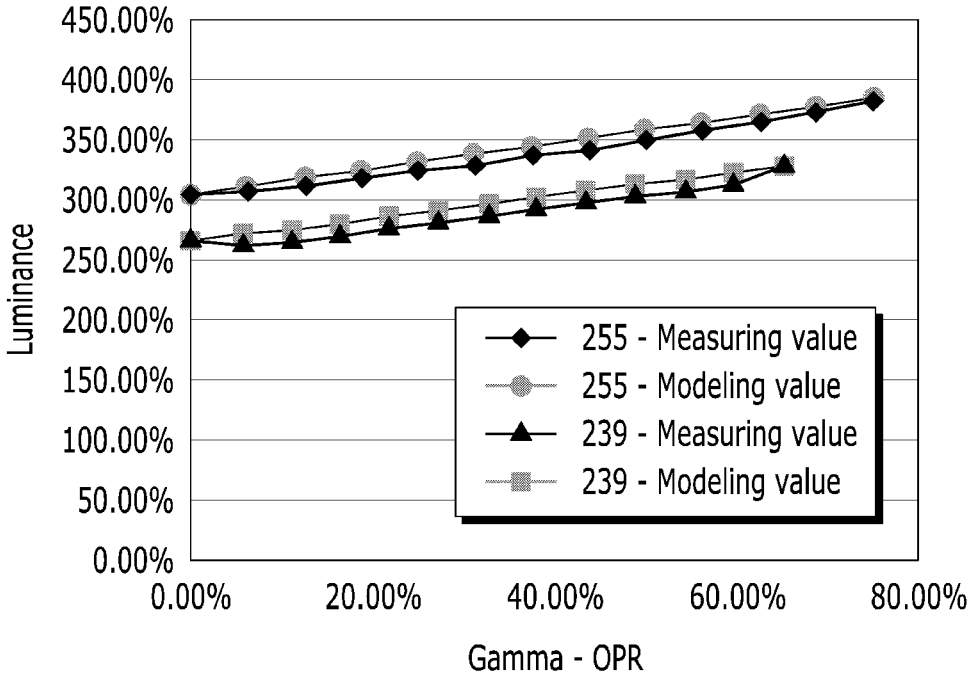
FIG. 4 is a graph of an actual measuring value of a luminance increasing ratio according to an OPR change ratio and a value calculated by modeling in 255 grayscale and 239 grayscale.

FIG. 4 is a graph of a measuring value (a real measuring luminance value) and a modeling value (a luminance value calculated by the modeling) in the 255 grayscale shown in Table 1. Also, the luminance differences by the measuring value and the modeling value in the 239 grayscale are shown together.

As shown in the graph of FIG. 4, the final luminance in the 255 grayscale and the 239 grayscale is similar to the modeling value of the final luminance calculated by the modeling unit 103 such that the customized compensation may be performed in the grayscale region in which the luminance is decreased by the load effect as well as the grayscale region in which the luminance is increased when compensating the grayscale data by the final luminance that is arithmetically calculated by using the modeling method.

Again as shown in FIG. 1, the image processing apparatus 100 includes the grayscale re-mapping unit 105 connected to the modeling unit 103.

The grayscale re-mapping unit 105 compensates the grayscale data of the input image data to re-map the image data with new grayscale data such that the image is displayed with a target luminance by reflecting a luminance change ratio for the on-pixel ratio according to the input image data.

Here, the target luminance means a luminance value included in a luminance range including a predetermined margin to the ideal luminance displayed by the original grayscale data of the input image data. The predetermined margin is not limited and may be variably determined corresponding to the display quality of the display panel.

As an exemplary embodiment for obtaining the new compensation grayscale data in the grayscale re-mapping unit 105, the final luminance value according to the OPR change for each grayscale arithmetically calculated in the modeling unit 103 may be used.

That is, when the memory unit 109 stores the luminance change ratio and the final luminance value calculated by the modeling unit 103 according to the OPR change ratio for each grayscale with a lookup table type, the new compensation grayscale value corresponding to the target luminance of the grayscale value according to the on-pixel ratio (OPR) of the input image data may be obtained by using the lookup table. The grayscale re-mapping unit 105 re-maps the new compensation grayscale value to generate an output image data.

For example, the on-pixel ratio (OPR) of the input image data is obtained as 50% and the predetermined grayscale information of the input image data is a 127 grayscale, and the grayscale re-mapping unit 105 obtains the grayscale value corresponding to the same final luminance value as the target luminance corresponding to the 127 grayscale among the final luminance value corresponding to the OPR of 50% based on the luminance increasing ratio according to the OPR change ratio generated in the modeling unit 103 and the lookup table of the final luminance value to re-map it as the new compensation grayscale.

Meanwhile, as another exemplary embodiment for obtaining the new compensation grayscale data, the grayscale re-mapping unit 105 may compensate the grayscale information of the input image data through the equation by using the on-pixel ratio (OPR) calculated in the input image data (Data-in).

The calculation of the grayscale (F_Gray) that must be newly mapped depends on Equation 4.

$$F_\text{Gray}=((G_in/255)\hat{}2.2-Del_Lx)\hat{}(1/2.2)*255+K_o \qquad \text{Equation 4}$$

Here, F_Gray is the grayscale value after the corresponding grayscale of the input image data is compensated, G_in is the grayscale value corresponding to the grayscale information of the input image data, and Del_Lx is the luminance increasing ratio corresponding to the on-pixel ratio of the input image data calculated in Equation 2.

Also. K_o is a compensation constant that must be compensated due to the on-pixel ratio that is changed by re-mapping the grayscale. That is, an error may be generated while the on-pixel ratio is changed according to the characteristic of the display panel by the grayscale compensation, and in this case, the compensation constant is an offset value to offset the error. The compensation constant that is changed according to the material characteristic of the corresponding display panel may be previously determined as the offset value according to the panel.

The grayscale re-mapping unit 105 maps the grayscale value that is newly obtained by compensating the grayscale information included in the input image data to store it to the memory unit 109 or to transmit it as the output image data (Data-out) through the image output unit 111.

Table 2 shows the compensation grayscale value (F_Gray) calculated according to the OPR change after assuming that the grayscale included in the input image data is 255 and K_o is 4.

In Table 2, the OPR that is changed corresponding to the compensation grayscale value calculated according to the change of the OPR is added. Also, the luminance percentage after the compensation represents the luminance when the luminance value of 300 nit that is ideally displayed in the 255 grayscale is assumed to be 100%, and the final luminance after the compensation is found by calculating the luminance value that is expected after the grayscale value compensation.

TABLE 2

| | | Luminance increasing amount | | Final luminance | | Compensation | | | |
|---|---|---|---|---|---|---|---|---|---|
| OPR | D-DELTA | REAL (%) | MODEL (%) | REAL | MODEL | F_Gray | OPR | Luminance % | Final luminance |
| 25.00% | 75.00% | 26.35% | 26.25% | 384.60 | 384.31 | 226 | 19.18% | 96.84% | 294.78 |
| 31.25% | 68.75% | 23.23% | 24.06% | 375.10 | 377.65 | 229 | 24.67% | 97.93% | 298.11 |
| 37.50% | 62.50% | 20.04% | 21.88% | 365.40 | 370.99 | 232 | 30.44% | 98.93% | 301.14 |
| 43.75% | 56.25% | 17.61% | 19.69% | 358.00 | 364.33 | 235 | 36.49% | 99.83% | 303.87 |
| 50.00% | 50.00% | 14.88% | 17.50% | 349.70 | 357.67 | 238 | 42.82% | 100.63% | 306.31 |
| 56.25% | 43.75% | 12.35% | 15.31% | 342.00 | 351.01 | 240 | 49.43% | 101.33% | 308.44 |
| 62.50% | 37.50% | 10.38% | 13.13% | 336.00 | 344.35 | 243 | 56.31% | 101.93% | 310.27 |
| 68.75% | 31.25% | 8.34% | 10.94% | 329.80 | 337.69 | 246 | 63.48% | 102.43% | 311.81 |
| 75.00% | 25.00% | 6.18% | 8.75% | 323.20 | 331.04 | 249 | 70.92% | 102.84% | 313.04 |
| 81.25% | 18.75% | 4.50% | 6.56% | 318.10 | 324.38 | 251 | 78.65% | 103.15% | 313.98 |
| 87.50% | 12.50% | 2.60% | 4.38% | 312.30 | 317.72 | 254 | 86.65% | 103.36% | 314.62 |

TABLE 2-continued

| | | Luminance increasing amount | | Final luminance | | Compensation | | | |
|---|---|---|---|---|---|---|---|---|---|
| OPR | D-DELTA | REAL (%) | MODEL (%) | REAL | MODEL | F_Gray | OPR | Luminance % | Final luminance |
| 93.75% | 6.25% | 1.12% | 2.19% | 307.80 | 311.06 | 256 | 94.93% | 103.47% | 314.96 |
| 100.00% | 0.00% | 0.00% | 0.00% | 304.40 | 304.40 | 259 | 103.48% | 103.48% | 315.00 |

Referring to Table 2, although the OPR is changed, the final luminance after the compensation is constantly maintained. That is, when comparing with the luminance value according to the OPR of Table 1, the final luminance after the compensation of Table 2 is compensated to be close to the ideal luminance value of 300 nit in a 255 grayscale although the OPR is changed.

Figure 5:
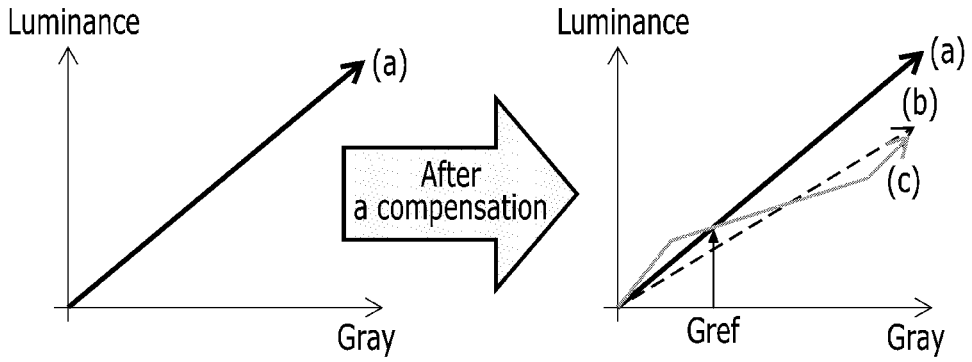
FIG. 5 is a graph of a relation of grayscale and a luminance after image data compensation according to a conventional art and an exemplary embodiment.

FIG. 5 is a graph of a relation of grayscale and luminance after image data compensation according to a conventional art and an exemplary embodiment of the present invention.

In FIG. 5, the actual luminance in the entire grayscale region is indicated by line (a), the luminance after the compensation of the conventional compensation method is indicated by a line (b), and the luminance after the compensation according to the present invention is indicated by a line (c).

The actual luminance (a) may be higher than the ideal display luminance corresponding to the corresponding grayscale in the high grayscale region by the load effect with respect to a predetermined reference grayscale (Gref), and may be lower than the ideal display luminance corresponding to the corresponding grayscale in the high grayscale region. Accordingly, according to the conventional compensation method, the luminance is indiscriminately decreased according to the full white grayscale like the line (b) such that the correction compensation of the luminance is difficult.

However, according to the image processing apparatus and the method thereof according to an exemplary embodiment, by the modeling method according to the luminance change ratio and the OPR change ratio and the grayscale re-mapping calculation, like the line (c), the luminance is increased in the grayscale region lower than the reference grayscale (Gref) and the luminance is decreased in the grayscale region higher than the reference grayscale (Gref) such that the compensation of the correct grayscale information is possible.

The reference grayscale may be the grayscale value displaying the luminance (the OPR luminance) corresponding to the on-pixel ratio of the input image data.

Meanwhile, the grayscale value that is changed to the decreasing ratio from the luminance increasing ratio based on the luminance change ratio for each grayscale calculated in the modeling unit 103 may be obtained as the reference grayscale.

That is, in the modeling unit 103 of the image processing apparatus, the luminance change ratio (including the increasing ratio and the decreasing ratio) is calculated according to the OPR change ratio for each grayscale to calculate the final luminance, and a point of the reference grayscale (Gref) where the luminance change ratio is converted from the increasing trend to the decreasing trend may be reversely detected.

The grayscale re-mapping unit 105 applies the compensation value with which the luminance is decreased in the high grayscale region and the compensation value with which the luminance is decreased in the low grayscale region with respect to the reference grayscale by using the values calculated in the modeling unit 103, thereby changing and outputting the grayscale value of the input image data.

Figure 6:
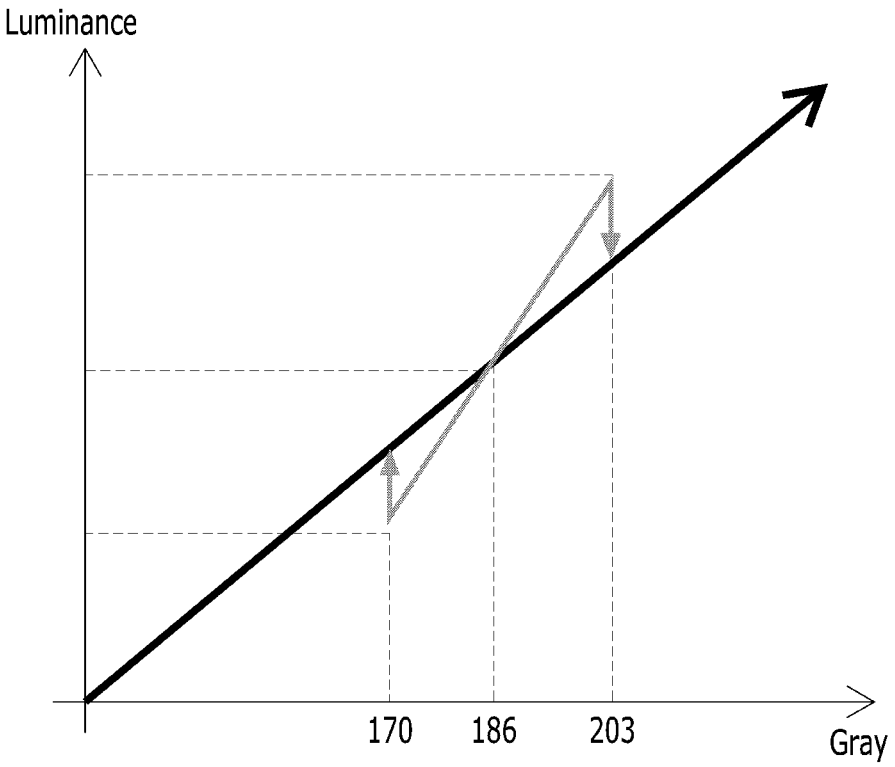
FIG. 6 is a graph of a compensation method of image data according to an exemplary embodiment.

FIG. 6 is a graph of a compensation method of an image data according to an exemplary embodiment, and shows the compensation method in a 203 grayscale as an upper grayscale and in a 170 grayscale as a lower grayscale when the reference grayscale (Gref) is a 186 grayscale.

Referring to FIG. 6, the 203 grayscale included in the high grayscale region for the reference grayscale 186 is displayed with the higher luminance than the ideal display luminance (indicated by a solid line of a thick arrow in FIG. 6), and therefore the luminance must be decreased by the compensation calculation method. Also, the 170 grayscale included in the low grayscale region for the reference grayscale 186 is displayed with the lower luminance than the ideal display luminance, and therefore the luminance must be increased by the compensation calculation method.

For example, when the OPR luminance is 50%, the 170 grayscale must increase the luminance by about 4%, and the 203 grayscale must decrease the luminance by 6%. However, although the difference (Gamma-OPR) between the ideal luminance (the gamma luminance) and the OPR luminance is 10% in a case of the 170 grayscale and in a case of the 203 grayscale, the compensation of the 203 grayscale is decreased by 6% and the compensation of the 170 grayscale is increased by 4%, thereby obtaining the effect that the actual power is decreased by about 2%.

However, this case is only an exemplary embodiment, and as another exemplary embodiment, a method of decreasing the data gamma voltage in the high grayscale region more than the reference grayscale and maintaining the data gamma voltage in the low grayscale region less than the reference grayscale as it is without the compensation may be provided.

There is no gamma voltage compensation in the low grayscale region such that the decreasing effect of the actual power consumption may be increased.

Figure 7:
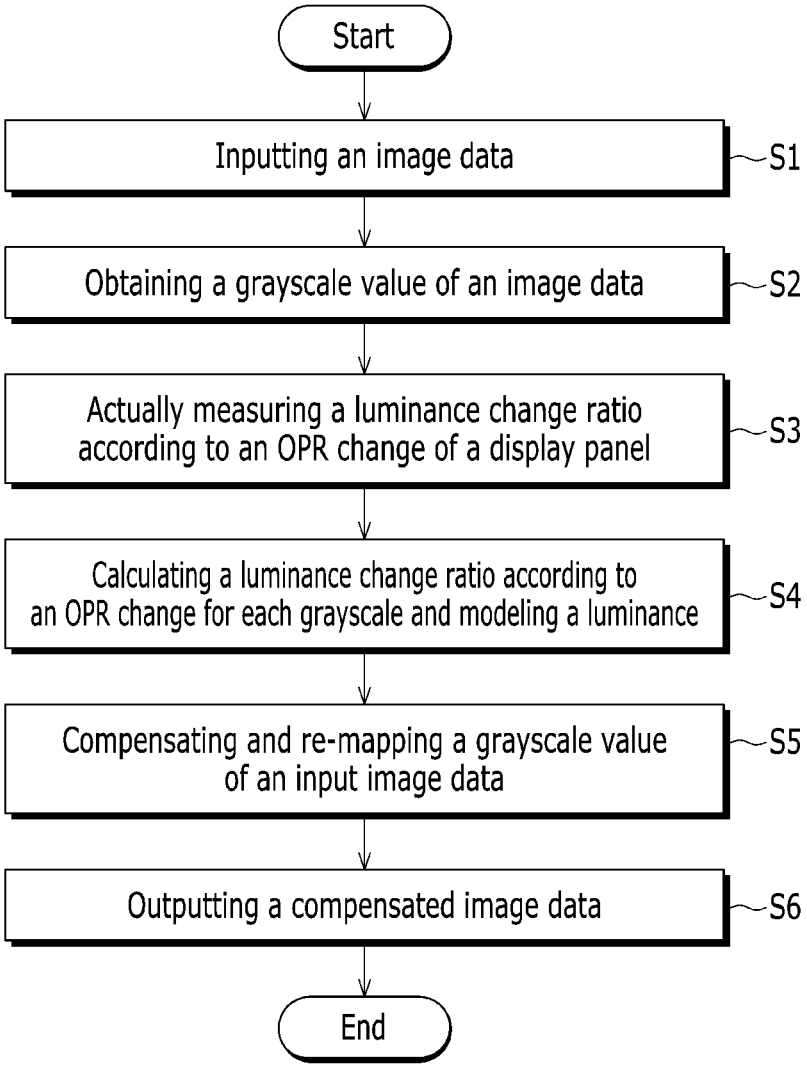
FIG. 7 is a flowchart of an image processing method according to an exemplary embodiment.

FIG. 7 is a flowchart of an image processing method according to an exemplary embodiment.

Firstly, the image data transmitted from an external image source is input to an image input unit of the image processing apparatus S1.

Grayscale information is obtained by analyzing the input image data S2. Obtaining the grayscale information included in the input data signal in the corresponding frame includes compensating the grayscale value, and changing the grayscale value into a new grayscale value before the grayscale value is supplied as the output image data. Also, the on-pixel ratio information may be calculated from the input image data.

In an exemplary embodiment, the luminance change ratio according to the OPR change may be measured by changing the on-pixel ratio (OPR) for the display panel S3. The step S3 is not always a necessary process included in the image processing process, and the actual luminance change ratio according to the OPR change for a predetermined grayscale may be measured through a previous additional process and actually measuring the display panel.

The predetermined value of the corresponding display panel may be obtained by calculating the actual luminance change ratio for the difference between the ideal luminance and the OPR luminance, and at this time, the predetermined value is used in an equation for modeling the luminance change ratio according to the OPR change for each grayscale and the final luminance.

The predetermined value of the display panel is included in the image processing process, however it may be obtained through an additional process, and may be provided as an offset value of the panel for the modeling.

Thus, the luminance change ratio according to the OPR change for each grayscale is calculated by using the predetermined value, and the final luminance value is calculated for the modeling for each grayscale S4. The result values by the modeling process may be stored to the memory unit with the lookup table type according to the OPR change for each grayscale.

Next, the output image data is re-mapped with a new compensation grayscale value compensating the grayscale value of the input image data S5. The compensation grayscale value may be obtained by finding the grayscale value corresponding to the target luminance of the grayscale value of the input image data based on the calculation result values (the luminance change ratio and the final luminance calculated through the modeling) obtained in the step S4. Also, the compensation grayscale value may be obtained by calculating the new grayscale value by reflecting the luminance change according to the on-pixel ratio of the input image data.

The compensation grayscale value may be reversely detected from the luminance change ratio and the final luminance value according to the OPR change stored through the modeling in the step S4, or may be calculated by the calculation equation of the compensation grayscale value reflecting the on-pixel ratio of the input image data.

Next, the output image data including the compensated grayscale data is output S6.

According to certain embodiments of the image processing method, the luminance value that is decreased in the grayscale region lower than the reference grayscale representing the OPR luminance is correctly increased for the compensation such that the output image data may be re-mapped with the correct grayscale value.

The gamma voltage may be changed by changing a gamma resistance string according to the OPR such that the luminance measuring is additionally required, thereby deteriorating production ratio. However, according to the image processing methods discussed herein, the grayscale value for the input image data is compensated and re-mapped through the modeling and the calculation process without a change of the gamma resistance string. Accordingly, a process for separately measuring the luminance of the display panel emitting the light according to the image data or tuning the gamma voltage is not necessary such that the luminance compensation is easy.

The drawings and the detailed description described above are examples and are provided to explain various aspects, and the scope of the present invention is not limited thereto. Therefore, it will be appreciated to those skilled in the art that various modifications may be made and other equivalent embodiments are available. Further, a person of ordinary skill in the art can omit part of the constituent elements described in the specification without deterioration of performance or can add constituent elements for better performance. In addition, a person of ordinary skill in the art can change the embodiments depending on the process conditions or equipment.

What is claimed is:

1. An image processing apparatus, comprising:

an image input unit configured to receive input image data from an external image source to obtain grayscale values for a display image;

a modeling unit configured to calculate a luminance change ratio of a display image for each grayscale value according to a change of an on-pixel ratio of a display panel and a final luminance reflected by the luminance change ratio;

a grayscale re-mapping unit configured to determine a compensation grayscale value for compensating a luminance change ratio according to the on-pixel ratio of the input image data to display a target luminance corresponding to a predetermined grayscale value included in grayscale values; and an image output unit configured to output output image data compensating the input image data by the compensation grayscale value, wherein the grayscale re-mapping unit is configured to calculate the compensation grayscale value corresponding to the grayscale value of the input image data according to the on-pixel ratio of the input image data, and wherein the compensation grayscale value is calculated by applying a compensation constant to offset an error by the on-pixel ratio that is changed according to a characteristic of the display panel by grayscale compensation.

2. The image processing apparatus of claim 1, wherein the grayscale re-mapping unit is configured to display the target luminance of the grayscale value of the input image data in the on-pixel ratio of the input image data based on the luminance change ratio and the final luminance calculated in the modeling unit.

3. The image processing apparatus of claim 1, further comprising a sampling unit connected to the image input unit and configured to measure luminance of the image that is actually displayed according to the grayscale information in the on-pixel ratio condition of the input image data.

4. The image processing apparatus of claim 3, wherein the sampling unit is configured to calculate a predetermined value according to the characteristic of the display panel used when calculating the luminance change ratio according to an OPR change ratio and the final luminance in the modeling unit.

5. The image processing apparatus of claim 4, wherein the predetermined value is a ratio of a luminance increasing ratio that is actually measured to a difference between the ideal luminance for the grayscale value and the luminance corresponding to the on-pixel ratio when the display panel is displayed with the grayscale value of the input image data in the on-pixel ratio condition of the input image data.

6. The image processing apparatus of claim 1, wherein the target luminance is included in a luminance range including a predetermined margin to the ideal luminance displayed with a predetermined grayscale value included in the grayscale information of the input image data.

7. An image processing method, comprising:

obtaining grayscale values of a display image by receiving input image data from an external image source calculating an on-pixel ratio of the input image data based on the grayscale values;

calculating a luminance change ratio of the display image for each grayscale value according to a change of the on-pixel ratio of the display panel and a final luminance reflected by the luminance change ratio;

determining a compensation grayscale value compensating a luminance change ratio according to the on-pixel ratio of the input image data to display a target luminance corresponding to a grayscale value in the on-pixel ratio condition of the input image data; and outputting output image data compensating the input image data by the compensation grayscale value, wherein the determining of the compensation grayscale value includes calculating the compensation grayscale value corresponding to the grayscale value of the input image data according to the on-pixel ratio of the input image data, and wherein the calculation of the compensation grayscale value is applied with a compensation constant for offsetting an error by the on-pixel ratio that is changed according to a characteristic of the display panel by grayscale compensation.

8. An image processing method, obtaining grayscale values of a display image by receiving input image data from an external image source calculating an on-pixel ratio of the input image data based on the grayscale values;

calculating a luminance change ratio of the display image for each grayscale value according to a change of the on-pixel ratio of the display panel and a final luminance reflected by the luminance change ratio;

determining a compensation grayscale value compensating a luminance change ratio according to the on-pixel ratio of the input image data to display a target luminance corresponding to a grayscale value in the on-pixel ratio condition of the input image data; and outputting output image data compensating the input image data by the compensation grayscale value, wherein the luminance change ratio and the final luminance are calculated by using the predetermined value according to a characteristic of the display panel, and before the calculation of the luminance change ratio and the final luminance, the predetermined value is calculated with a ratio of the luminance increasing ratio that is actually measured for a difference between an ideal luminance corresponding to a predetermined grayscale displayed to the display panel in the on-pixel ratio condition and the luminance corresponding to the on-pixel ratio.

9. The image processing method of claim 8, wherein the compensation grayscale value is for displaying a target luminance of the grayscale value of the input image data in the on-pixel ratio of the input image data based on the luminance change ratio and the final luminance.

* * * * *